US008727800B2

(12) United States Patent
Holland et al.

(10) Patent No.: US 8,727,800 B2
(45) **Date of Patent: *May 20, 2014**

(54) COAXIAL CONNECTOR WITH ENHANCED SHIELDING

(71) Applicants: Holland Electronics, LLC, Ventura, CA (US); Kai-Chih Wei, Taipei (TW)

(72) Inventors: Michael Holland, Santa Barbara, CA (US); Kai-Chih Wei, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/759,220

(22) Filed: Feb. 5, 2013

(65) Prior Publication Data

US 2013/0196542 A1 Aug. 1, 2013

Related U.S. Application Data

(63) Continuation of application No. 12/949,334, filed on Nov. 18, 2010, now Pat. No. 8,376,769.

(51) Int. Cl.
*H01R 9/05* (2006.01)

(52) U.S. Cl.
USPC ..... 439/322

(58) Field of Classification Search
USPC ..... 439/320, 321, 322, 578
See application file for complete search history.

(56) References Cited

U.S. PATENT DOCUMENTS 3,336,563 A 8/1967 Hyslop
4,106,839 A * 8/1978 Cooper ..... 439/607.18
4,525,017 A 6/1985 Schildkraut et al.
5,137,471 A 8/1992 Verespej et al.
5,683,263 A 11/1997 Hsu
6,217,383 B1 4/2001 Holland et al.
6,712,631 B1 3/2004 Youtsey
6,716,062 B1 4/2004 Palinkas et al.
7,131,867 B1 11/2006 Foster et al.
7,479,035 B2 1/2009 Bence et al.
7,587,244 B2 9/2009 Olbertz
7,674,132 B1 3/2010 Chen
7,753,705 B2 7/2010 Montena
7,828,595 B2 11/2010 Mathews
7,892,024 B1 2/2011 Chen
8,029,315 B2 * 10/2011 Purdy et al. ..... 439/578
8,062,044 B2 11/2011 Montena et al.
8,062,063 B2 11/2011 Malloy et al.
8,113,875 B2 * 2/2012 Malloy et al. ..... 439/578
8,113,879 B1 * 2/2012 Zraik ..... 439/584
8,157,589 B2 4/2012 Krenceski et al.
8,167,636 B1 5/2012 Montena
8,172,612 B2 5/2012 Bence et al.
8,192,237 B2 * 6/2012 Purdy et al. ..... 439/792
8,231,412 B2 * 7/2012 Paglia et al. ..... 439/607.17
8,272,893 B2 * 9/2012 Burris et al. ..... 439/578
8,287,320 B2 * 10/2012 Purdy et al. ..... 439/792
8,313,345 B2 * 11/2012 Purdy ..... 439/578
8,313,353 B2 * 11/2012 Purdy et al. ..... 439/792
8,323,053 B2 * 12/2012 Montena ..... 439/578
8,323,060 B2 * 12/2012 Purdy et al. ..... 439/792

(Continued)

*Primary Examiner* — Neil Abrams
(74) *Attorney, Agent, or Firm* — Paul D. Chancellor; Ocean Law

(57) ABSTRACT

A male F-Type coaxial cable connector has an improved RF shield including a bridge located between and electrically interconnecting a connector fastening nut and a connector body portion. The bridge may be in the form of a metal ring, or similar material, with a cone-like shape and may include a gap to provide resiliency.

6 Claims, 7 Drawing Sheets

(56) References Cited

U.S. PATENT DOCUMENTS

| | | | | |
|---|---|---|---|---|
| 8,348,697 | B2 * | 1/2013 | Zraik | 439/578 |
| 8,366,481 | B2 * | 2/2013 | Ehret et al. | 439/578 |
| 8,376,769 | B2 * | 2/2013 | Holland et al. | 439/322 |
| 8,517,763 | B2 * | 8/2013 | Burris et al. | 439/578 |
| 8,529,279 | B2 * | 9/2013 | Montena | 439/322 |
| 2012/0225581 | A1 | 9/2012 | Amidon et al. | |
| 2013/0164975 | A1 * | 6/2013 | Blake et al. | 439/578 |

* cited by examiner

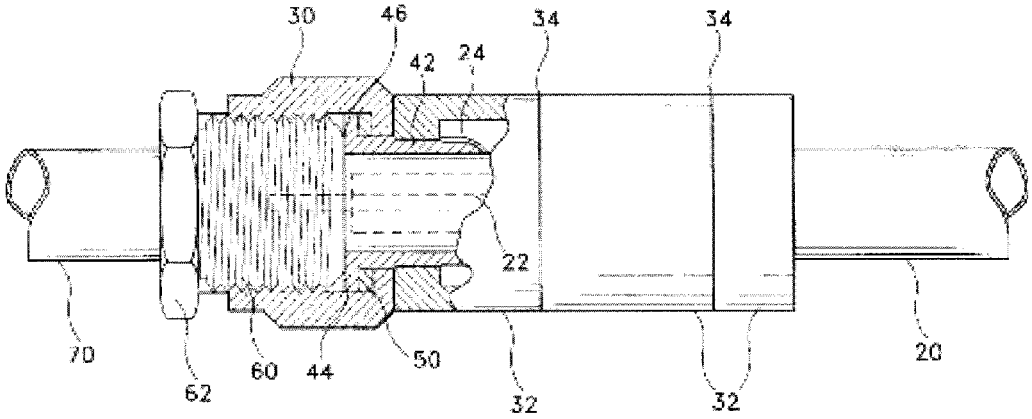
Figure 1A,
PRIOR ART PATENT 6,712,631 to Youtsey
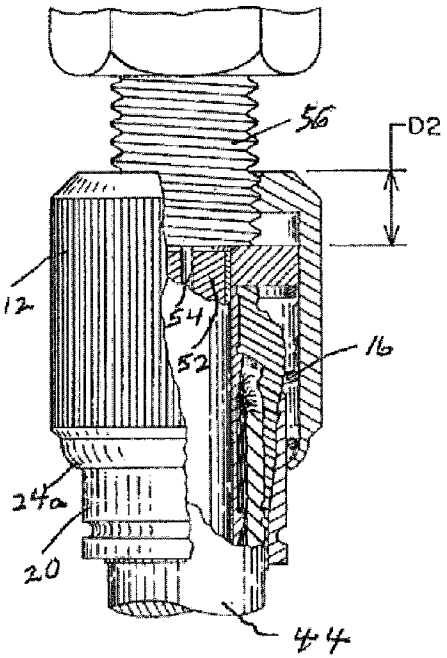
Figure 1B,
PRIOR ART PATENT 6,716,062 to Palinkas et al.

PRIOR ART PATENT 7,753,705 to Montena

PRIOR ART PATENT 7,753,705 to Montena

PRIOR ART PATENT PUB. 2010/0255721 to Purdy et al.

COAXIAL CONNECTOR WITH ENHANCED SHIELDING

PRIORITY CLAIM

This application is a continuation of U.S. patent application Ser. No. 12/949,334 filed Nov. 18, 2010 and entitled COAXIAL CONNECTOR WITH ENHANCED SHIELDING.

BACKGROUND OF THE INVENTION

1. Field of the Invention

The present invention relates to an article of manufacture for conducting electrical signals. In particular, a male F-Type coaxial cable connector includes a bridge enhancing the electromagnetic shielding provided by the mated connector.

2. Discussion of the Related Art

With the increased use of internet/data applications on Cable TV systems, it has been found that outside electrical noise and signal ingress into the CATV network interferes with the data signals and reduces the velocity or speed of signal propagation. Because shielding tends to reduce this undesirable interference, increasing the shielding of every component in the distribution system has become a goal of CATV system designs seeking improved data transmission performance.

One source of noise ingress in cable distribution systems is the coaxial cables' F-Type connector. Male F-Type connectors generally include a post, a flange located at one end of the post, a rotatable front attachment nut engaging the flange, and a connector body affixed to the post adjacent to the nut. Typically, the signal shield of these connectors is degraded when the attachment nut is loose. Despite attachment nut tightening specifications, such as 30 inch-pounds torque for some connectors, intended to insure a high degree of conductivity and radio frequency ("RF") shielding, movement of the coaxial cable, variations in temperature, or poor initial installation workmanship can cause the F-Type male nut to loosen, allowing RF ingress through the RF gap created.

Initial attempts to solve the F-Type connector shielding problem have been aimed at maintaining a tight front nut. This approach uses a split or locking washer 50 as shown in prior art FIG. 1A disclosed in U.S. Pat. No. 6,712,631 to Youtsey. In this washer behind the flange design, tightening the nut 30 on a mating part 62 compresses the locking washer between the flange 44 and the rear wall of the nut. This method has had some success in resisting vibrational loosening, but it fails to prevent RF ingress if the nut is installed loose or later becomes loose.

A second approach seeks to reduce RF ingress by providing good ground continuity and RF shielding even when the front nut is loose. In a spring 16 behind the flange 26 design as shown in prior art FIG. 1B disclosed in U.S. Pat. No. 6,716,062 to Palinkas et al., the second approach is implemented using a compressed spring that surrounds the post and operates to push the flange away from the rear wall of the nut which tends to press the male connector's flange against the female connector's mating front face. By connecting the male and female connector ground planes, shielding is enhanced. It is a disadvantage that this design requires a larger and more costly male connector nut assembly to house the spring.

Others implement the second approach using a spring 12 in front of the flange design as shown in prior art FIGS. 1C and 1D disclosed in U.S. Pat. No. 7,753,705 to Montena. This spring is electrically and mechanically attached to the flange's outer periphery or its inner bore which is part of the male connectors' ground plane assembly. It is a disadvantage that this design operates over only a short compression distance.

A third approach has been to attach an electrically conductive spring 110 between the loose nut and the flange as shown in prior art FIG. 1E disclosed in U.S. Pat. No. 7,479,035 to Bence et al. This type of design is especially useful where the connector has a nonconductive outer body. Disadvantages of this design include a large contact spring and grounding to an inner, smaller diameter ground plane.

SUMMARY OF THE INVENTION

The present invention provides a coaxial cable connector with enhanced shielding. Various embodiments include one or more of the features described below.

An electrically conductive member interconnecting the front attachment nut and the connector body assures DC continuity and RF shielding to an F-Type male coaxial cable connector when the front attachment nut is loose. Unlike traditional loose nut shielding methods, embodiments of the present invention locate an electrical contact member between the connectors' attachment nut and a connector conductive body. Because RF currents travel mostly on a conductors' outer surface, the use of the connector body as a conductor offers, in various embodiments, one or more of enhanced shielding, mechanical performance, and environmental performance as compared to traditional designs. Moreover, in various embodiments, the present invention requires no spring or similar shielding member to electrically interconnect the attachment nut and either of the post and flange of the connector ferrule tube.

In an embodiment, an improved male F-Type connector radio frequency shield comprises an electrically conductive nut and a post substantially surrounded by an electrically conductive body. A nut partition separates a nut forward cavity and a nut rear cavity bounded at least in part by a nut overhang. The nut forward cavity encircles a flange at one end of the post and the nut rear cavity receives a forward mouth of the connector body. Also included is an electrically conductive bridge having a frustoconical shape and a centerline about coincident with a central axis of the connector. The bridge is interposed between the forward mouth of the connector body and the nut overhang; and, the bridge mechanically contacts and thereby electrically interconnects the nut and the connector body.

In some embodiments, the connector bridge is operable as a spring to press against a peripheral wall of the nut rear cavity. And, in some embodiments the bridge is in the form of a partial ring with a gap and the bridge operable as a spring to grip the forward mouth of the connector body. In various embodiments, the nut partition and/or the forward mouth of the connector body prevent the bridge from contacting the flange and the post.

BRIEF DESCRIPTION OF THE DRAWINGS

The present invention is described with reference to the accompanying figures. These figures, incorporated herein and forming part of the specification, illustrate the invention and, together with the description, further serve to explain its principles enabling a person skilled in the relevant art to make and use the invention.

FIGS. 1A-E show prior art coaxial cable connectors.

DETAILED DESCRIPTION OF THE PREFERRED EMBODIMENTS

The disclosure provided in the following pages describes examples of some embodiments of the invention. The designs, figures, and description are non-limiting examples of embodiments they disclose. For example, other embodiments of the disclosed device and/or method may or may not include the features described herein. Moreover, disclosed advantages and benefits may apply to only certain embodiments of the invention and should not be used to limit the disclosed invention.

Figure 1C:
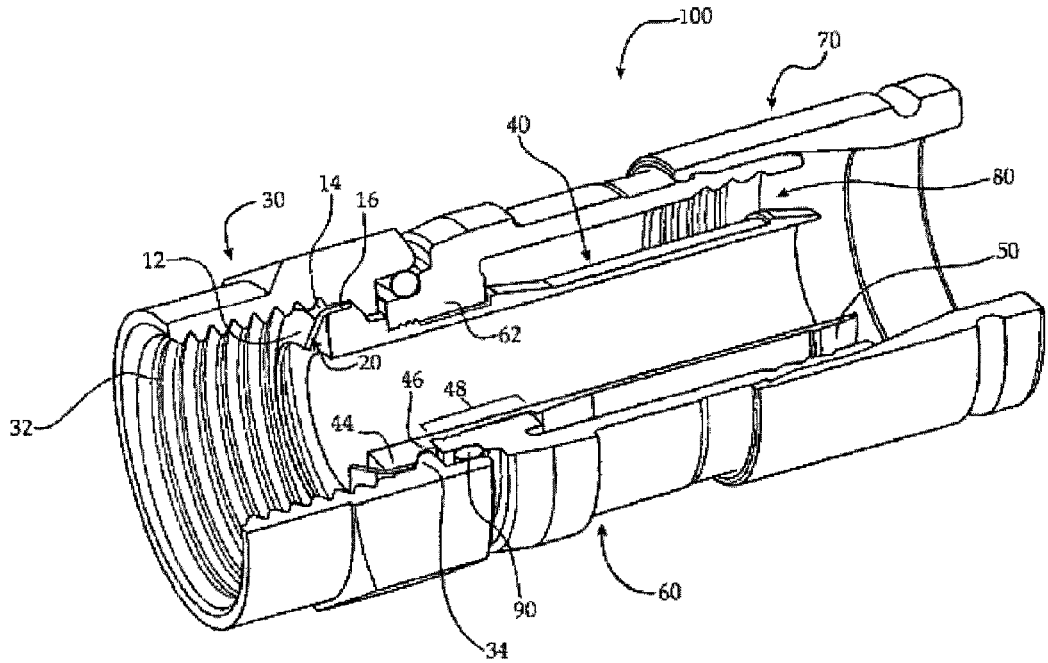
Figure 1D:
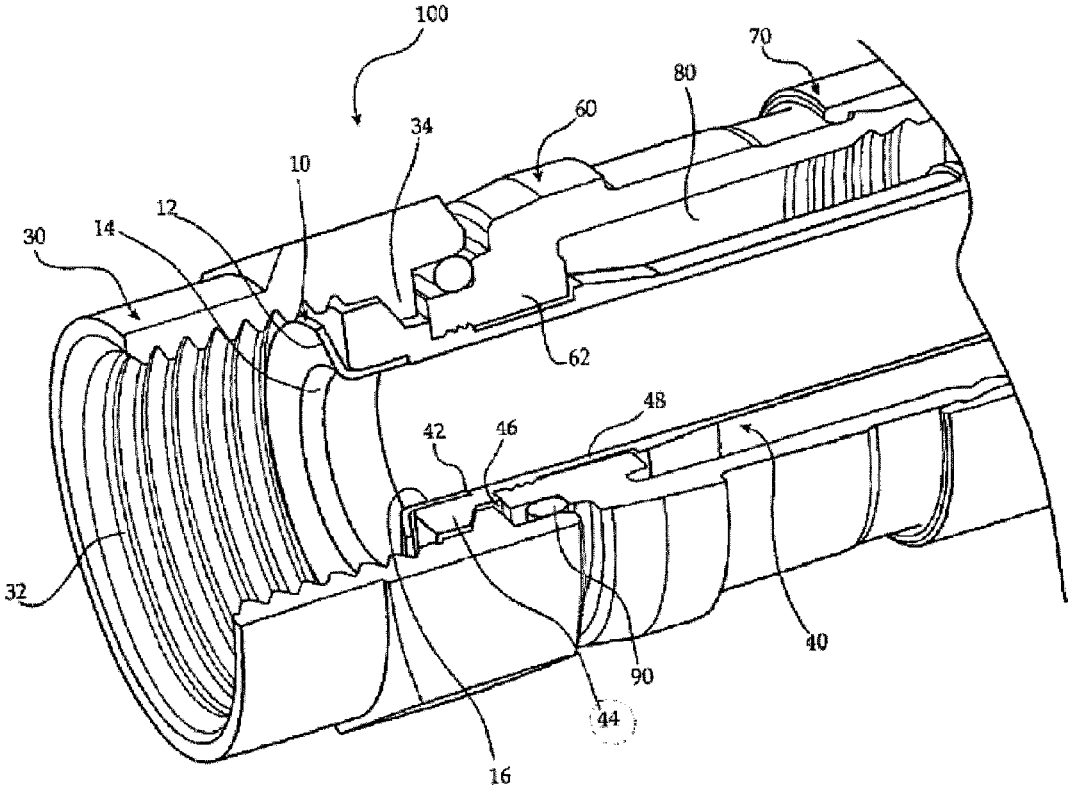
Figure 1E:
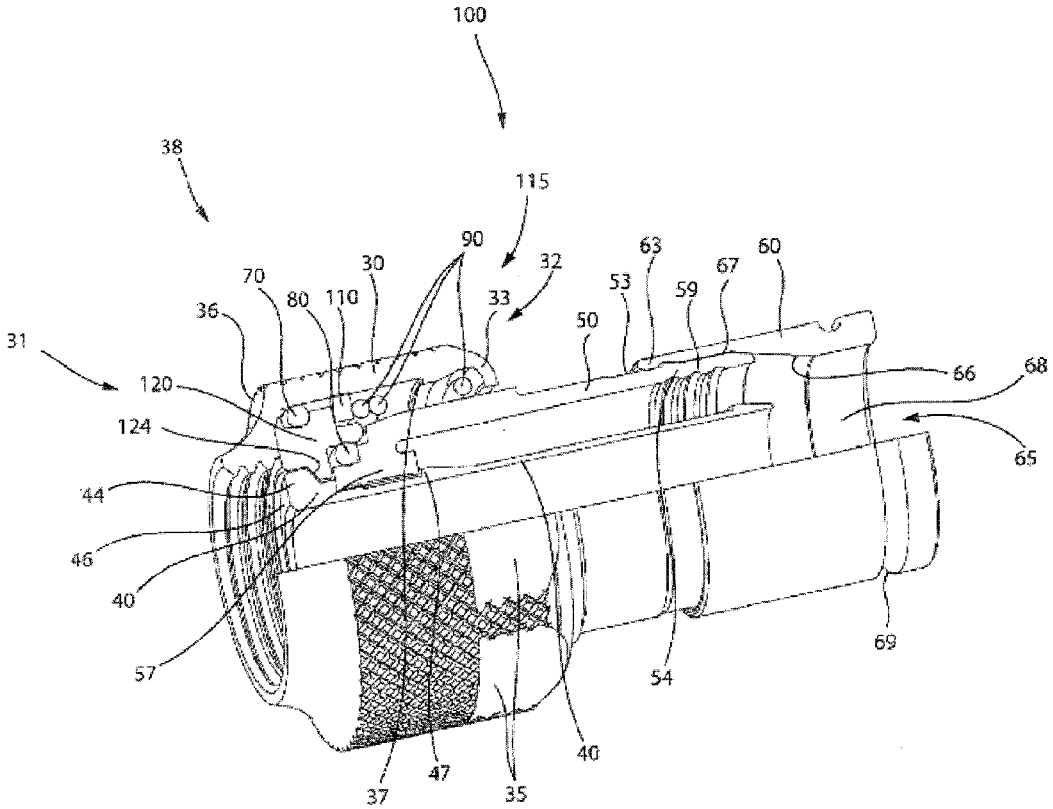
Figures 2A, 2B:
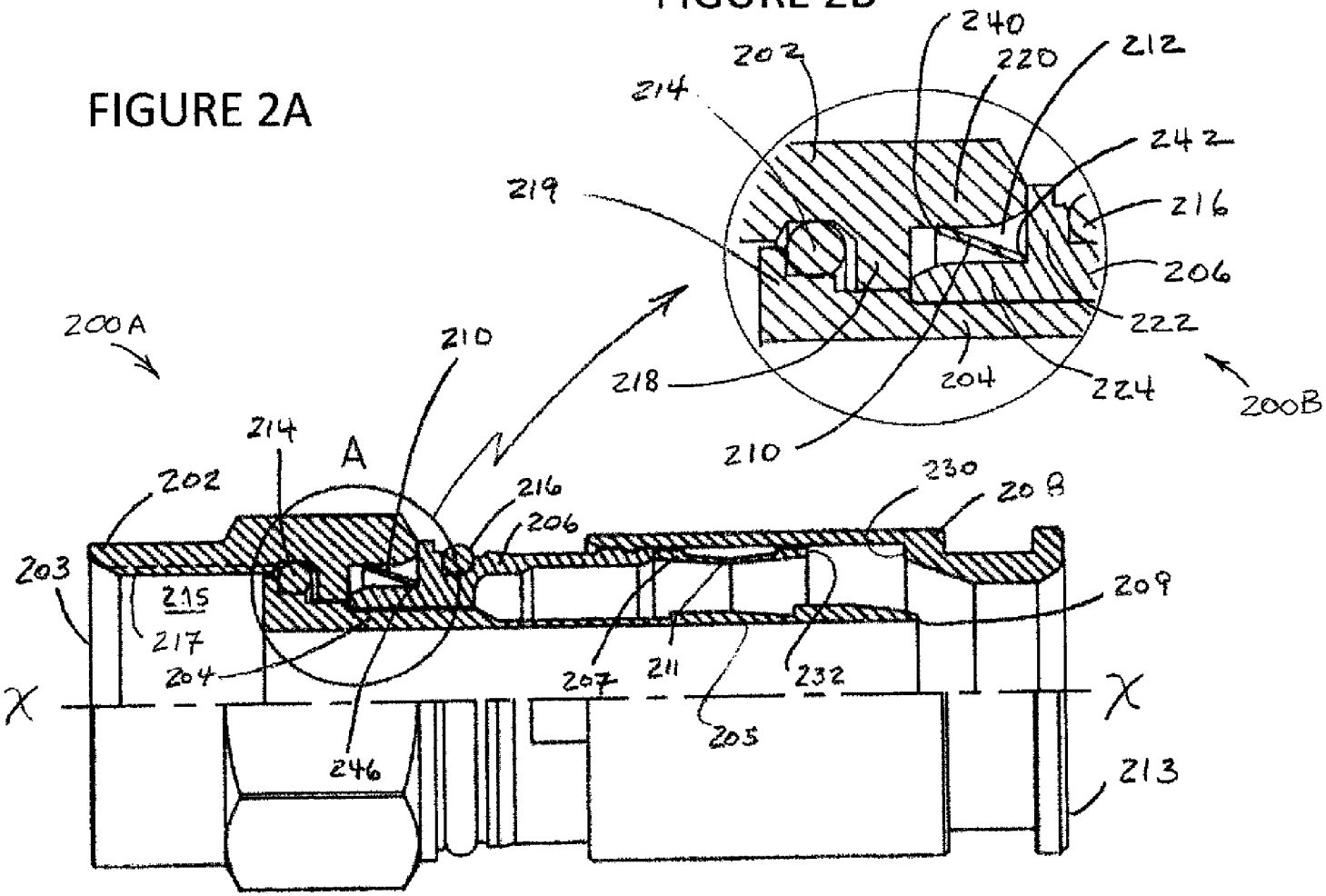
FIGS. 2A,B show a side view in partial cross-section of a male F-Type type coaxial cable connector in accordance with the present invention.

FIGS. 2A,B show a male F-Type coaxial cable connector in accordance with the present invention 200A,B. The connector includes a post 204, a flange or flange-like structure 219 opposite a trailing end of the post 209, a rotatable front attachment nut surrounding the flange 202, and a connector body 206 affixed to the post adjacent to the nut. The nut end of the connector is referred to as the forward end 203 and the opposite end of the connector is referred to as the trailing end 213. A nut forward cavity 215 is prepared, such as with threads 217, for mating with a female F-Type coaxial cable connector or port.

In some embodiments, the present invention includes one or both of means for fixing a coaxial cable to the connector and means for moisture sealing the interior of the connector. An exemplary means for affixing a prepared end of a coaxial cable to the connector 200A,B includes cooperation of a movable outer shell 208 with a deformable, trailing portion of the body 207 (as shown).

During deformation, a central region 211 of the deformable body portion moves radially inward toward the connector centerline X-X. This deformation squeezes the coaxial cable between the deformable body portion and barb(s) on the post's trailing end 205. Deformation occurs when the deformable body portion's free end 232 is pushed forward by an annular face 230 of the moving outer shell. As persons of ordinary skill in the art will appreciate, this embodiment describes one of many known cable/connector fixation designs that are suitable for use with the connector of the present invention.

Exemplary moisture seals are shown in the embodiment of FIGS. 2A,B where a first moisture seal such as an O-ring 214 is for sealing between the rotatable nut 202 and the post 204. Also shown is a second exemplary moisture seal such as another O-ring 216 for sealing between the body 206 and the outer shell 208. The use of these and other suitable moisture seals will be known to skilled artisans.

In various embodiments of the present invention, enhanced shielding includes one or both of enhanced DC continuity and enhanced RF shielding of the male F-Type coaxial connector. Shielding is enhanced by providing a continuous or substantially uninterrupted ground plane surrounding the center conductor of the coaxial cable portion inserted in the connector. In particular, the rotatable connector nut 202 and the connector body 206 are electrically conductive and electrically connected such that to the extent they surround the coaxial cable center conductor, they provide an effective RF shield around it.

Notably, the electrically interconnected nut 202 and body 206 ground plane provides a relatively low impedance RF path as compared to designs implementing an electrically interconnected nut and post 204 or flange 219 design. Lower impedance results because the RF signal travels primarily on the surface of a conductor and the surface area (diameter) of the connector body is larger than the surface area (diameter) of the post.

FIGS. 2A,B shows an exemplary conductive bridge 210 providing an electrical connection between the nut 202 and the body 206. In some embodiments, one or more of a nut partition 218, a nut overhang 220, a body forward mouth 224, and a forward body shoulder 222 are adjacent to the bridge. And, in some embodiments the bridge fits in a pocket 212. In an embodiment, the bridge fits in a pocket formed by the nut partition 218, the nut overhang 220, the body forward mouth 224, and the forward body shoulder 222 (as shown).

Suitable bridges are made from materials including resilient materials. In various embodiments bridge materials include one or both of metallic and non-metallic conductors. Exemplary bridge materials include: Metallic conductors such as stainless steel, steel, beryllium, copper, or an alloy of one or more of these metals; non-metallic conductors such as a conductive polymer; and, composite conductors such as a non-metallic matrix containing conductive material(s) such as finely divided conductive metal and carbon based materials.

Figure 3:
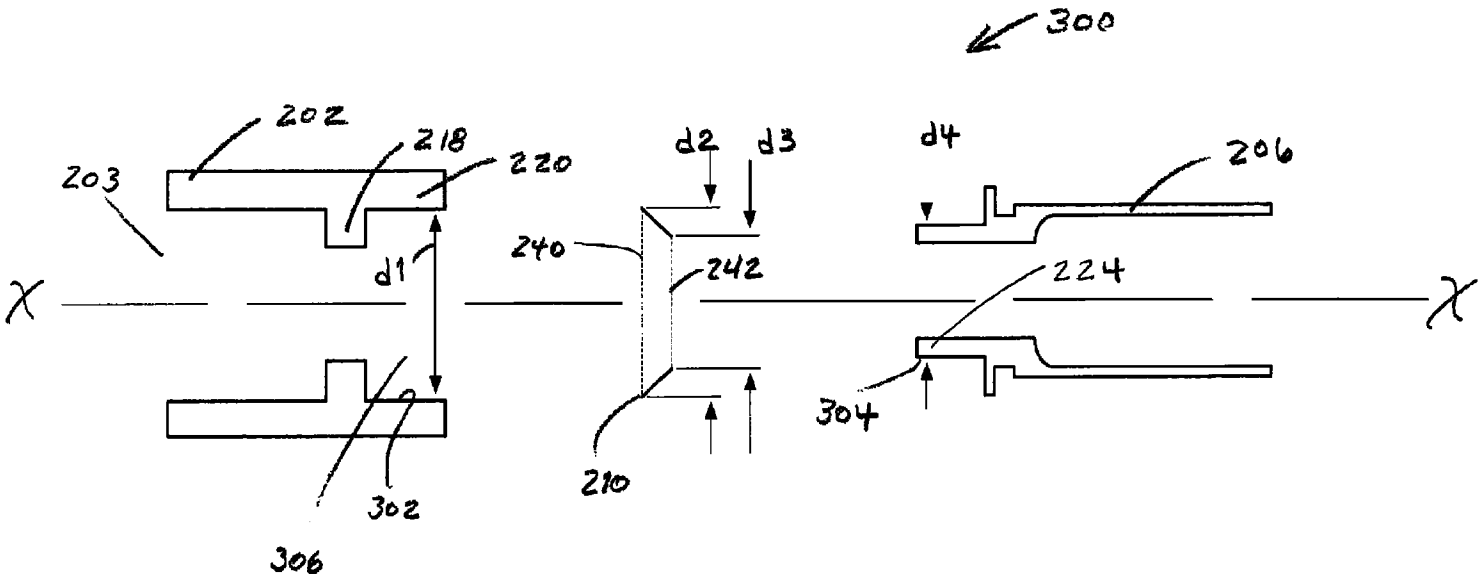
FIG. 3 shows an exploded view of selected parts of the coaxial cable connector of FIGS. 2A,B.

FIG. 3 shows an exploded diagram of a first portion of the connector 300. The conductive bridge 210 is shown and the interengaging attachment nut 202 and connector body 206 are shown. When assembled (see also FIGS. 2A,B), the bridge touches both the attachment nut 202 and the connector body 206 establishing an electrical path therebetween. Notably, the nut is free to rotate with respect to the connector body as the bridge rubs against one or both of the nut and the body.

In an embodiment, the bridge 210 has a frustoconical shape with a major lip 240 and a minor lip 242 (as shown). The bridge is designed to fit within the rear cavity of the nut 306 such that the major lip of the bridge interengages an interior surface of a nut rear cavity 302. A second interengagement occurs where the bridge minor lip touches an outer surface 304 of the connector body forward mouth 224.

Whether the bridge 210 is in the form of a partial or a continuous ring, during interengagement the bridge touches the nut 202 and the connector body 206. In an embodiment, the bridge's major lip describes an interengaging outer diameter d2 that is larger than the inner diameter of the nut rear cavity d1 forming a first interference fit. And, in an embodiment, the bridge's minor lip describes an interengaging inner diameter d3 that is smaller than the outer diameter d4 of the body forward mouth forming a second interference fit. In various embodiments the bridge lips are continuous and create continuous lines of contact with the nut and the connector body. And, in some embodiments, the bridge lips are discontinuous and create discontinuous lines of contact with the nut and the connector body.

Figure 4:
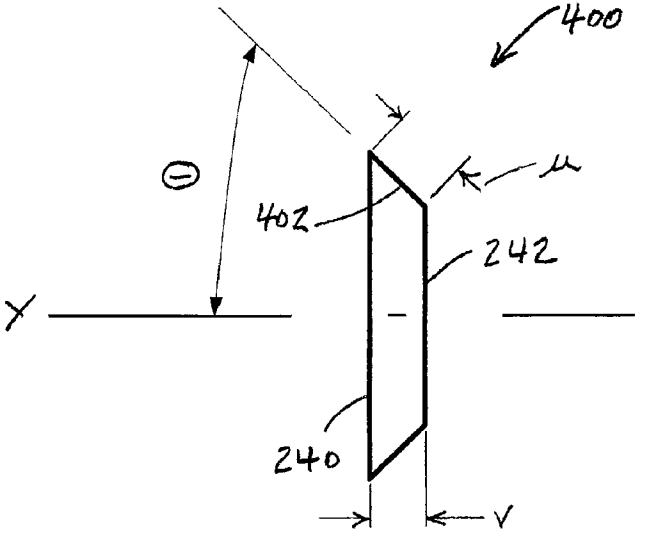
FIG. 4 shows a side view of a bridge for use with the coaxial cable connector of FIGS. 2A,B.
Figure 5:
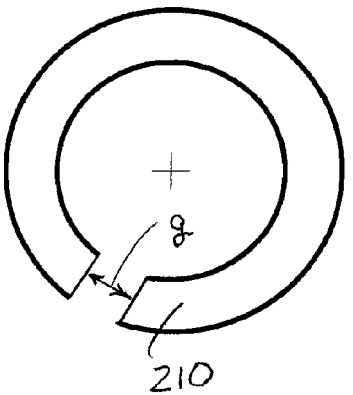
FIG. 5 shows a plan view of a bridge for use with the coaxial cable connector of FIGS. 2A,B.
Figure 6:
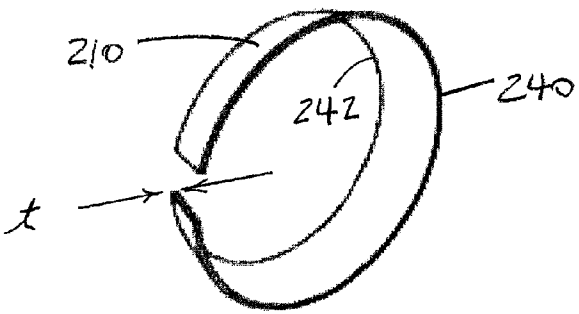
FIG. 6 shows a perspective view of a bridge for use with the coaxial cable connector of FIGS. 2A,B.

FIGS. 4-6 show exemplary plan, side, and perspective views illustrating bridge designs 400, 500, 600. In FIG. 4, a bridge side view shows a bridge sidewall 402 extending between major and minor lips of the bridge 240, 242. The side wall and a bridge centerline Y-Y describe a bridge angle θ.

As can be seen, for a given sidewall length u, the width of the bridge v is a function of angle θ; increasing θ reduces width while decreasing θ increases width. In various embodiments, the bridge angle θ varies in the range of about 15 to 50 degrees and in some embodiments the bridge angle θ varies in the range of about 30 to 40 degrees.

As will be appreciated by persons of ordinary skill in the art, bridge dimensions d2, d3 are selected in light of nut and connector body dimensions d1, d4. Bridge thickness t is selected to maintain snug fits and good electrical contacts with the nut 202 and the connector body 206

Suitable bridge thickness is a function of the bridge material properties and the bridge angle θ. For example, a stainless steel part might be made from a 304 stainless or similar material with Rockwell B hardness in the range of about 90-94 and with a thickness in the range of about 0.3 to 0.6 millimeters. In an embodiment, a bridge is made from 304 stainless with a Rockwell B hardness of 92 and a thickness of 0.4 mm.

FIG. 5 shows a plan view of a partial ring bridge 500. Here, a variable gap g in the ring forming the bridge 210 enables the bridge to accommodate a range of connector body forward mouth outer diameters d4. In accordance with the mechanical properties of the bridge material, accommodating larger body mouths by increasing the gap also tightens the fit between the bridge and the connector body 206. In addition, increasing the gap increases the bridge outer diameter d2 which tightens the fit between the bridge and the nut 202.

A feature of the partial ring bridge design is that energy associated with bridge deformation can be stored in corresponding gap changes. This provides an increased range of resilient bridge deformation as compared to bridges without a similar energy storing capacity such as a continuous ring bridge.

Another feature of the partial ring bridge design is that energy associated with bridge deformation can be stored in corresponding changes in the angle θ. For example, tightening the fit between the nut and the bridge tends to flatten the bridge as evidenced by a reduced angle θ.

In operation, a conductive bridge 210 enhances the RF shield. In various embodiments, the bridge is located between the nut's rear cavity 302 and a mouth of the connector body forward mouth 224. The conductive bridge contacts the nut and the connector body forward mouth providing an electrical path therebetween. Because of the fits between the bridge and each of the nut and the connector body forward mouth, the electrical interconnection is maintained whether the nut is loose or tight. For example, the electrical interconnection and the enhanced RF shield are maintained whether the nut is loose or tightly fastened to a mating female F-Type connector port.

When the nut 202 is tightened onto a mating port, the bridge rubs against the nut and/or the connector body forward mouth. In some embodiments, this relative motion tends to clean mating electrical contact areas and enhance conductivity between the nut and the connector body 206. And, in some embodiments tightening the nut also tends to reduce the bridge angle θ and enhance conductivity between the nut and the connector body, for example by one or more of relative motion rubbing/cleaning and increased bridge contact forces.

While various embodiments of the present invention have been described above, it should be understood that they have been presented by way of example only, and not limitation. It will be apparent to those skilled in the art that various changes in the form and details can be made without departing from the spirit and scope of the invention. As such, the breadth and scope of the present invention should not be limited by the above-described exemplary embodiments, but should be defined only in accordance with the following claims and equivalents thereof.

What is claimed is:

1. An improved male F-Type connector with radio frequency shield comprising:

a post and an electrically conductive nut, the post surrounded at least in part by an electrically conductive body;

the nut encircles a post end flange and the nut receives a forward mouth of the connector body;

an electrically conductive bridge having a cone-like shape and a centerline about coincident with a central axis of the connector;

the bridge interposed between the forward mouth of the connector body and a nut inner wall; and, the bridge mechanically contacting and thereby electrically interconnecting the nut and the connector body.

2. The connector of claim 1 wherein the bridge is configured as a spring to press against a peripheral wall of the nut.

3. The connector of claim 2 wherein the bridge is in the form of a partial ring with a gap and the bridge is configured to grip the forward mouth of the connector body.

4. A method of shielding a male F-Type connector comprising the steps of:

providing a post with a flanged end and a nut encircling the flange;

an electrically conductive connector body surrounding at least a portion of the post;

a connector body end extending into a gap between the nut and the post;

providing a electrically conductive bridge having a cone-like shape and a centerline about coincident with a central axis of the connector; and, the bridge mechanically contacting and electrically interconnecting the nut and the connector body.

5. The shielding method of claim 4 further comprising the step of configuring the bridge as a spring to press against a peripheral wall of the nut.

6. The shielding method of claim 5 further comprising the steps of:

configuring the bridge as a partial ring with a gap; and, configuring the bridge to grip the forward mouth of the connector body.

* * * * *